US007727064B1

(12) United States Patent
Luciano, Jr.

(10) Patent No.: US 7,727,064 B1
(45) Date of Patent: Jun. 1, 2010

(54) INTERACTIVE BINGO GAMING SYSTEM AND METHOD

(75) Inventor: Robert A. Luciano, Jr., Reno, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 1231 days.

(21) Appl. No.: 10/825,605

(22) Filed: Apr. 14, 2004

(51) Int. Cl.
*A63F 9/24* (2006.01)

(52) U.S. Cl. ..... 463/19

(58) Field of Classification Search ..... 463/16–20; 273/269

See application file for complete search history.

(56) References Cited

U.S. PATENT DOCUMENTS 5,679,077 A * 10/1997 Pocock et al. ..... 463/19
5,830,067 A * 11/1998 Graves et al. ..... 463/40
6,368,214 B1 * 4/2002 Luciano ..... 463/18
6,581,935 B1 * 6/2003 Odom ..... 273/269
7,628,691 B2 * 12/2009 Luciano et al. ..... 463/18

* cited by examiner

*Primary Examiner*—Peter DungBa Vo
*Assistant Examiner*—Jasson H Yoo
(74) *Attorney, Agent, or Firm*—Michael A. Kerr; Kerr IP Group, LLC

(57) ABSTRACT

A system and method of playing an interactive bingo game. Each game session comprises a plurality of game events in which the bingo game draws at least one bingo number from a set of bingo numbers. The player is provided with one or more bingo cards. The game drawn bingo numbers are matched to the bingo cards and the player is awarded a prize according to a dynamic paytable. The dynamic paytable depends on a plurality of dynamic variables that are modified during the game session. The dynamic paytable further comprises a plurality of triggering events that are associated with a plurality of bingo patterns, and a threshold event that is engaged after one or more triggering events. The threshold event is configured to determine a plurality of prize credits awarded for each subsequent bingo pattern. For the chargeable action embodiment, the player is charged one or more credits for each of the game events and the credits that are charged are determined by said player. For the average bet embodiment, the player is only charged at the beginning of the game session.

17 Claims, 10 Drawing Sheets

INTERACTIVE BINGO GAMING SYSTEM AND METHOD

CROSS REFERENCE

This patent application is related to patent application Ser. No. 10/214,862 filed on Aug. 7, 2002 which is related to patent application Ser. No. 10/041,940 filed on Oct. 17, 2001 (now abandoned) which is related to patent application Ser. No. 09/665,742 filed on Sep. 20, 2000 (U.S. Pat. No. 6,368,214) which is related to patent application Ser. No. 09/267,126 filed on Mar. 10, 1999 (now U.S. Pat. No. 6,129,632) which is related to patent application Ser. No. 08/866,931 filed on May 31, 1997 (now abandoned), all of which are hereby incorporated by reference.

BACKGROUND

1. Field

The present invention is an interactive bingo gaming system and method. More particularly, the invention provides a skill based interactive bingo gaming system and method.

2. Background

Traditional Bingo is played in person in a large hall. Players meet at the hall, pay a fee to get in, then the games begin. A night of Bingo consists of many Bingo games played continuously, one after another.

To play Bingo, each player purchases one or more cards divided into numbered and blank squares. Traditionally, there are 75 possible Bingo numbers: B1, B2, B3, . . . B15, I16, I17, I18, . . . I30, N31, N32, . . . O74, O75. A numbered ball that resides in a large rotating bin represents each of the Bingo numbers. An announcer spins the bin, reaches in and selects a ball, and announces it to the room. The players check all of their cards to see if that number appears on their card. If there is a match with the announced numbers, then the player's mark the card accordingly. When a player has a Bingo (5 in a row, column, or diagonal), he or she calls out Bingo.

The game is paused while the card is verified. If the player's card is a winner, the game stops and a new game begins. If the player's card is not a winner, the game proceeds where it left off. Each Bingo game proceeds until someone wins the game.

In traditional Bingo, a player's chances of winning depend on the number of cards in the game and how many cards are being played. For example, if a player has 10 cards in a game with 1000 cards, the chances of winning for that player is 1 in 100.

There are many variations or combinations of Bingo. In one popular variation, the central square of the card is empty; the first player that has a row of five numbers that are either vertically, horizontally, or diagonally is the winner. In another variation, the player is awarded a prize if the "Four Corners" of the Bingo card are filled. In yet another variation, the player is awarded a prize if all the numbers on the Bingo card are selected; this variation is called "Blackout" Bingo.

Bingo is played as a game of chance. The selection of a Bingo card is a relatively random event. Additionally, the drawing of each bingo ball is also a random event. The most obvious skill each player must have is to scan the Bingo card quickly and identify any Bingo numbers that have been called by the announcer. This can be especially difficult if the player has more than one Bingo card and the announcer is calling numbers quickly. However, in a computing environment, software identifies the Bingo numbers on a Bingo card and little or no skill is required to play Bingo.

Bingo can also be played on an electronic device. Generally, the electronic device provides the player with an opportunity to select a Bingo card and draws Bingo numbers. The Bingo numbers are identified on the player Bingo card if there is a match between the number listed on the player card and the drawn Bingo number. As such this process require little or no skill.

To enhance the gaming experience, a Bingo game that provides a player with an opportunity to use player skill has been conceived. For purposes of this patent, "player skill" includes three components: minimal skill, dexterity skill, and knowledge skill. Generally, all games include these components, however, the degree of skill varies for each game. Minimal skill requires a minimal understanding of the rules of the game and minimal dexterity needed to apply the rules of the game. To play a game according to the game rules, the player must possess minimal skill.

A lottery game is a game that in principle only requires minimal skill. The minimal skill required is the selection of numbers from a card having a plurality of numbers within. The correct amount of numbers must be identified before the lottery drawing. The game outcome is theoretically random so little or no dexterity skill or knowledge skill is used. Other games that theoretically rely on random events include traditional keno and stand-alone slot machines.

Dexterity skill is based on the player's reflexes or coordination. Most games require a degree of dexterity to establish game play. Certain games such as arcade video games or pinball machines are primarily dexterity based skill games. For example, in the well-known "Pong" video game, the player removes bricks from a wall by causing a ball to "hit" the brick with a player controlled paddle. Dexterity skill is needed to ensure that the ball strikes the paddle so that the player may continue playing the game. The objective during game play is to generate as many points as possible, and this objective is generally achieved by playing the game as long as possible.

Knowledge skill is based on the player's experience and analytical abilities. Most games require a degree of knowledge skill during game play. For example, the Pong game described above requires a certain amount of knowledge skill in anticipating how the ball will bounce off the brick wall. However, this level of knowledge is minimal when compared to the level of dexterity skill applied in Pong.

An illustrative example of a game that uses knowledge skill is a standard video poker game of Jack or Better. In this video poker game a player is provided with a choice of which cards to hold and which cards to discard in exchange for newer cards. The optimum choice made by the player is dependent on the paytable for the video poker game. For illustrative purposes, with a paytable that pays a Royal Flush 800, a Straight Flush 50, Four of a Kind 25, a Full House 9, a Flush 6, a Straight 4, Three of a Kind 3, Two Pair 2 and a Pair of Jacks or Better 1, the player has a theoretical optimum return of 99.5%. Thus, if a player starts with a $20 bill, and wagers $1 at a rate of six games per minute, this loss rate is $1.80 per hour and on average the player could play for 11 hours before consuming all the playing funds. In the illustrative example of the standard video poker machine, the knowledge skill used by the player is dependent on the amount wagered, the cards initially dealt to the player, the cards discarded by the player, the new cards provided to the player and the paytable for compensating the player. During the game session, the player attempts to optimize his/her award according to the paytable. Since the optimal player outcome is dependent on the paytable, a "knowledgeable" player's decision will be highly dependent on the paytable. The paytable provided in the illustrative standard video poker machine is a static paytable. A static paytable does not change during game play and provides a fixed award for each award event.

A traditional Bingo game is a game that in principle only requires minimal skill. The minimal skill required includes the selection of a Bingo card and the identification of drawn numbers on to the Bingo card. The game outcome is theoretically random so little or no dexterity skill or knowledge skill is used. For example, if the Bingo game is enabled in an electronic device that identifies the winning numbers on the Bingo card, then little or no dexterity skill is required. Additionally, since each drawing of a Bingo number is theoretically random, little or no knowledge based skill is used by the player.

SUMMARY

A method of playing an interactive bingo game. Each game session comprises a plurality of game events in which the bingo game draws at least one bingo number from a set of bingo numbers. The player is provided with one or more bingo cards. The game drawn bingo numbers are matched to the bingo cards and the player is awarded a prize according to a dynamic paytable. The dynamic paytable depends on a plurality of dynamic variables that are modified during the game session. The dynamic paytable further comprises a triggering event that is associated with each bingo pattern, and a threshold event that is engaged after one or more triggering events. The threshold event is configured to determine a plurality of prize credits awarded for each of the subsequent patterns. For the chargeable action embodiment, the player is charged one or more credits for each of the game events and the credits that are charged are determined by said player. For the average bet embodiment, the player is only charged at the beginning of the game session.

An interactive bingo gaming system comprises a player interface, a dynamic paytable, a prize meter and a termination button. The player interface is configured to display at least one bingo card and display at least one bingo number being drawn from a set of bingo numbers. The dynamic paytable for the interactive bingo gaming system determines the prize credits awarded for each bingo pattern. The prize meter is incremented each time the threshold event occurs. The termination button permits the player to terminate said game session after each game event. For the chargeable action embodiment, a credit meter is configured to record charging the player one or more credits for each game event in which the bingo number is drawn from the set of bingo numbers.

BRIEF DESCRIPTION OF THE DRAWINGS

Embodiments of the present invention are shown in the accompanying drawings.

DESCRIPTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the claims.

Illustrative Gaming System

Figure 1:
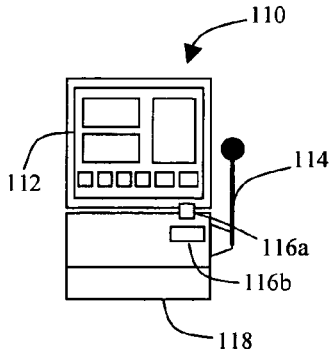
FIG. 1 is an illustrative stand-alone system for the interactive bingo game.

Referring to FIG. 1 there is shown an illustrative stand-alone device 110 configured to provide an interactive bingo gaming system and method. In the illustrative embodiment, the stand-alone device 110 is an electronic device that has a touch screen video display 112 which acts as a player interface. The illustrative video displays player interface 112 embodiment is described in further detail below.

The electronic device 110 includes a dedicated gaming device, a computer having interactive bingo gaming software, a personal digital assistant, or any other such device or combination of devices that displays the interactive bingo game of the present invention. As shown, the illustrative stand alone device 110 also includes a handle 114 that acts as a player interface component. The function of handle 114 may be similar to the function of a handle in a conventional slot machine.

Additionally, the illustrative stand alone device 110 includes a monetary input component that is configured to receive money or transferable credits, respectively. The illustrative monetary input component 116*a* is a device adapted to receive coins. The illustrative monetary input component 116*b* is a device adapted to receive transferable credits. The transferable credits may be provided by a coupon based system. Other monetary input components may be configured to receive bills, credit cards, debits cards, smart cards, electronic currency and other such means for transferring money or credits.

A coin hopper 118 is used to distribute an award to the player. It shall be appreciated by those skilled in the art that any other components for distributing awards may also be used instead of the coin hopper 118. These other components for distributing awards include a paper coupon, a smart card, a mag stripe card, or any other such means that can record the transfer of money or credits to the player.

Figure 2:
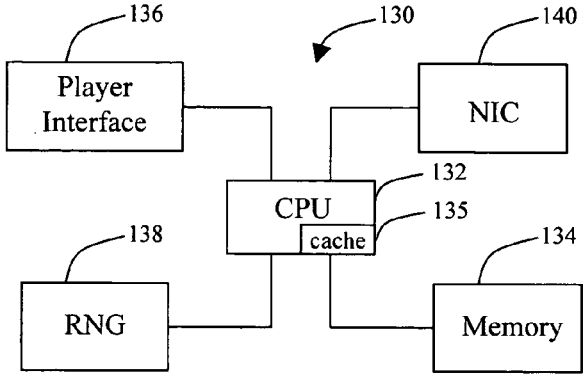
FIG. 2 is an illustrative block diagram of the system for the interactive bingo game of FIG. 1.

Referring to FIG. 2 there is shown an illustrative block diagram of the system for the stand alone device 110. The system 130 for the stand alone 110 device includes a logic component that is operatively coupled to internal components that manage the various gaming systems and operations for the interactive bingo game. In one embodiment, the electronic device may be a computer in which the logic component is a central processing unit (CPU) 132 and a memory 134 that stores the gaming operations and processes of the interactive bingo game. A fast memory cache 135 may also be employed by the CPU 132 to more efficiently access data or software stored in the memory 134. It shall be appreciated by those skilled in the art that the memory cache is a memory that is resident on the CPU 132. Additionally, it shall be appreciated by those skilled in the art that logic component does not have to be a CPU and may include a plurality of logic gates and switches that are either programmed, e.g. a field programmable gate array, or may be an application specific integrated circuit (ASIC).

Additionally, in the illustrative embodiment a player interface 136 is operatively coupled to the CPU 132. As previously described the player interface 136 may include a touch screen video display 112 and a handle 114. Alternatively, the player interface 136 may also include a video display (not shown) having a plurality of switches (not shown) that permit the player to interact with the stand alone device 110. Another alternative player interface 136 is a computer monitor (not shown) having a keyboard or mouse (not shown). The player interface includes a monetary input as described above or maybe configured to store credit or debit card information. Thus, the player interface 136 includes any interface that permits the player to interact with the stand alone system and input desired gaming parameters according to bingo game playing rules.

Thus the processor 132 is in operative communication with the memory 134 and the player interface 136. The processor 132 processes instructions that awards the player a prize when the output of the player interface matches an award identified by the paytable.

In an illustrative embodiment, a random number generator 138 is also operatively coupled to the CPU 132. The random number generator 138 is typically a software module used in the selection of a bingo number during a game session. The game session is defined as a period during which a plurality of bingo numbers are picked from the set of available bingo numbers. In addition to terminating a game session according to well known bingo game rules, the bingo game session can be terminated based on a player instruction. The bingo numbers may also be represented as letters, geometric figures, animated figures or any combination thereof. Alternatively, the picking of a bingo number may be simulated using systems and methods that provide the appearance of a random selection.

In another alternative embodiment, the stand alone device 110 may include a network interface card (NIC) 140 that permits the stand alone device 110 to communicate with a plurality of other devices configured to play the interactive bingo game. The NIC 140 uses well known networking protocols to communicate with other networked devices. These well known protocols include Ethernet type protocol, TCP/IP protocols or other such network protocols. Additionally, the stand alone devices maybe networked to provide access to a progressive jackpot. The progressive jackpot is a shared jackpot generated from the network of game devices.

Figure 3:
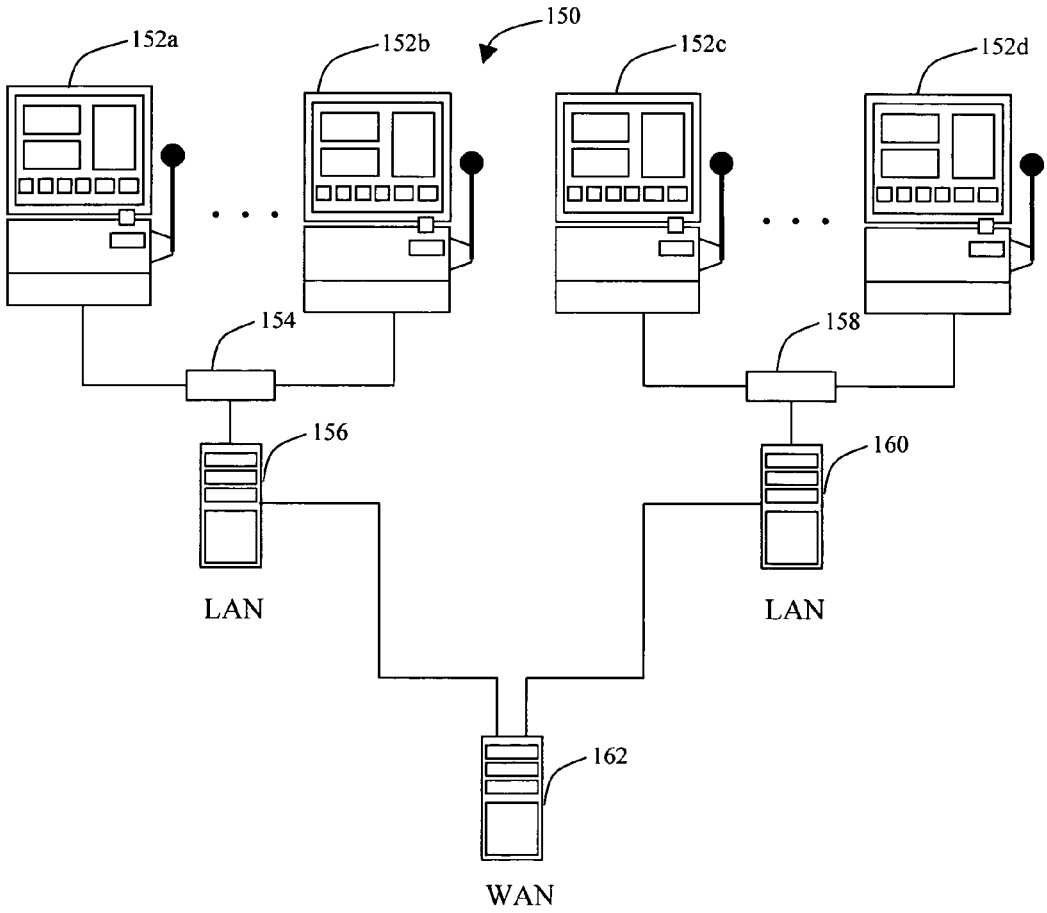
FIG. 3 is an illustrative network system having a plurality of networked systems for the interactive bingo game.

Referring to FIG. 3 there is shown an illustrative network system 150 having a plurality of networked devices 152*a* through 152*d*. Preferably, the networked devices 152*a* through 152*d* are similar to the stand alone device 110. In the illustrative network system 150, the networked devices 152*a* through 152*b* are operatively coupled to a node 154 that communicates with a local area network (LAN) server 156. Additionally, the networked devices 152*c* through 152*d* are also operatively coupled to a node 158 that is communication with a LAN server 160. The nodes 154 and 168 may be a hub, router, bridge, gateway or any combination thereof that allows communications between the networked devices. It shall be appreciated by those skilled in the art that each LAN may operate independently of the other.

A wide area network (WAN) is created by linking the LANs together. For illustrative purposes only, both LANs communicate with a WAN server 162. For purposes of this disclosure, it can be appreciated that the distinction between a LAN and WAN is primarily geographic in nature. The LAN is geographically limited to a bank of stand alone devices that may be resident on the casino floor. A WAN permits banks of networked devices from different casinos to be networked. A primary purpose for networking the gaming devices is to generate a progressive jackpot. Additional reasons for networking include accounting, diagnostics, player tracking and loyalty programs.

An alternative embodiment to the illustrative network system 150 comprises having the game logic for the interactive bingo game resident on a central server. The central server may be either the LAN server 156 or WAN server 162. During game play, the server then communicates game outputs to the appropriate client, i.e. one of the networked devices 152*a* through 152*d*. Yet another embodiment includes having the central server pick the bingo numbers and submit the bingo numbers to each of the clients on the network.

Interactive Bingo Gaming Method

For purposes of this patent, a game session comprises a plurality of game events. The game session is initiated by having the player express a desire to play a game according to the set of game rules. Each game event that occurs during the game session is subject to a set of game rules. The set of game rules also determines how the player is charged for the game session and how the game session is terminated.

The set of game rules determines the level of player skill that may be applied during a game session. The significance of player skill should not be underestimated. For example if the player adopts a skill based strategy that increases the player's return on investment or payback percentage from 90% to 91%, then the player can play 11% more game sessions. If the player adopts an even better skill based strategy that increases the payback percentage to 92%, then the player can play 25% more game sessions. Thus, by adopting a successful skill based strategy, more game sessions can be played with the same "bankroll" or "wad". A bankroll or wad is the total amount of money the player has allocated to playing the game.

Figure 4:
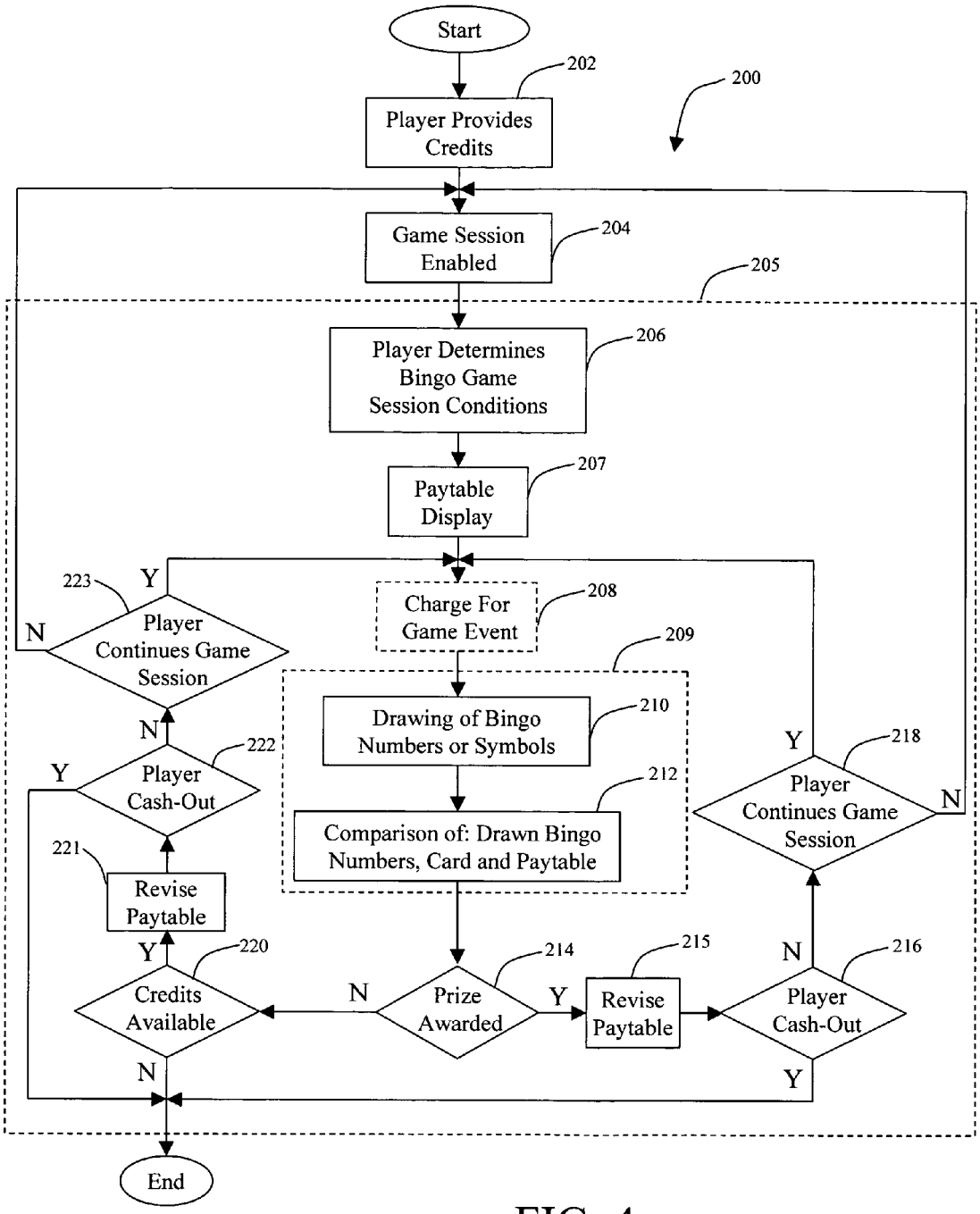
FIG. 4 is a flowchart of a method for playing the interactive bingo game.

FIG. 4 is a flowchart of a method for playing the interactive bingo game of the present invention. The method 200 for playing the interactive bingo game is initiated at block 202 by having the player provide credits. The providing of credits includes the inserting of money using coins or currency or the providing of transferable credits derived from coupons, a smart card, a player account, a credit account, or any other such accounts that receive credits or currency. The credits are needed to enable the new game session for the interactive game as described in block 204. Once the game session is initiated a player interface having one or more bingo cards is displayed. By way of example and not of limitation, the illustrative example of one bingo card is described in further detail. However, it shall be appreciated by those skilled in the art having the benefit of this disclosure that a plurality of bingo cards may be displayed.

The new game session includes the plurality of game events within process blocks boundary 205. The game session comprises the steps of determining the game session conditions, charging the player for the game events, and revising a paytable. The first of these steps is shown in process block 206. At block 206, the player configures the interactive bingo game play conditions for the game session 205. The game session 205 is initiated by the player inputting game conditions at block 206.

One game condition performed at block 206 requires a player to use an existing bingo card or select a bingo card from a plurality of bingo cards. In the chargeable action embodiment, the game condition includes having the player determine the amount of credits the player is going to be "charged" for each game event in which one or more bingo numbers are drawn. The process of charging a player for drawing one or more bingo numbers is also referred to as a "chargeable action". In another embodiment, referred to as the average bet embodiment the player is charged only at the beginning of the game session. The method then proceeds to process block 207.

At process block 207, a paytable is displayed. The paytable is inter alia dependent on the conditions input by the player in process block 206. The paytable indicates the possible prizes that may be awarded to the player. Preferably, the paytable is a dynamic paytable that is modified during the game session. By way of example and not of limitation, a dynamic paytable may be modified as a function of dynamic variables that include: the number of matching bingo numbers; the remaining bingo numbers after each drawing; the total quantity of bingo numbers; and the contribution or allocation of each award level to the overall payback. For the chargeable action embodiment, the dynamic paytable may also be dependent on the amount of credits associated with each chargeable action. For the average bet embodiment, the dynamic paytable may depend on the number of total credits wagered at the beginning of the game session. The dynamic paytable is described in further detail in FIG. 4 below. Alternatively, the paytable may be static paytable that does not change during the game session. The method then proceeds to block 208.

For the chargeable action, the method proceeds to block 208 where the player is charged for drawing one or more bingo numbers. The player is charged according to the quantity of credits identified in block 206. Thus, the player is charged before the drawing of one or more bingo numbers. For the average bet embodiment, block 208 is skipped.

At process block 210, the bingo numbers are picked by the interactive bingo game. At least one bingo number is picked during this game event. At block 212 a comparison of the bingo card numbers, the at least one number picked during the bingo game event, and the paytable is performed. The purpose for performing the comparison is to determine whether there is a winning bingo pattern.

At decision diamond 214, it is determined whether a prize is awarded. The type of prize awarded is dependent on the paytable displayed at block 209. The player is awarded a prize when there is a winning bingo pattern. The generation of a winning bingo pattern is a "triggering event" that results in the player being awarded prize credits. For a player to be awarded a prize, the paytable must indicate that a prize is to be awarded for the particular bingo pattern. If a prize is awarded then the method proceeds to process 215.

At block 215, the illustrative dynamic paytable is revised. The dynamic paytable is revised due to the probability changes that resulted from the triggering event. The prize credits awarded for generating subsequent winning bingo patterns is referred to as a threshold event. The method for determining the prizes awarded for generating subsequent bingo patterns is described in further detail in FIG. 5 below. Alternatively, the paytable may be static. The method then proceeds to decision diamond 216.

At decision diamond 216, the player is provided with an opportunity to terminate the game session. At decision diamond 216, the player must determine whether to conclude the game session by cashing out or to continue the playing the interactive game session. The determination of whether to conclude the game is based on the player's skill in analyzing the dynamic paytable and any visible counters that monitor the interactive bingo game session. If the player decides to cash-out and ends the game session, then the player is awarded his prize and the game session is concluded. If the player decision is to continue playing the interactive game session, then the method proceeds to decision diamond 218.

At decision diamond 218, the player has the opportunity to either continue the game session, or end the current game session and start a new game session. If the player decides to continue the same game session, then the player is returned to process block 208 for the next chargeable action. If the player decides to end the current game session and start a new game session, then player is returned to process block 204 and a new game session is initiated.

Returning to decision diamond 214, if the player is not awarded a prize at decision diamond 214, then the method proceeds to decision diamond 220 in which the gaming device and/or system determines whether the player has sufficient credits to continue playing the interactive bingo game.

If at decision diamond 220, the game determines the player does not have sufficient credits to continue the interactive bingo game, then the game session is concluded. However, if at decision diamond 220, the player does have sufficient credits to continue the game session, then the method proceeds to decision diamond 221.

At block 221, the dynamic paytable is revised as described in block 215. Alternatively, the paytable may be static. The method then proceeds to decision diamond 222.

At decision diamond 222, the player has an opportunity to minimize losses associated with the prior game event. At decision diamond 222, the player may terminate the interactive bingo game session by cashing out. The determination to terminate the game depends on inter alia the player's skill in analyzing the paytable and the plurality of meters that monitor the interactive game session. If the player decides not to terminate the interactive bingo game session at decision diamond 222, the method proceeds to decision diamond 223.

At decision diamond 223, the player has a second opportunity to minimize his losses. At decision diamond 223, the player has an opportunity to continue the game session or terminate the game session and start a new game session. The determination of whether to continue the game session is achieved by the player's skill in analyzing the paytable that was revised at block 221, and the plurality of meters that monitor the interactive game. If the player decides to continue the game session, then the player proceeds to process block 208, and the player is charged for the next chargeable action. If the player decides to end the current game session and start a new game session, then player is returned to process block 204 and a new game session is initiated.

Figure 5:
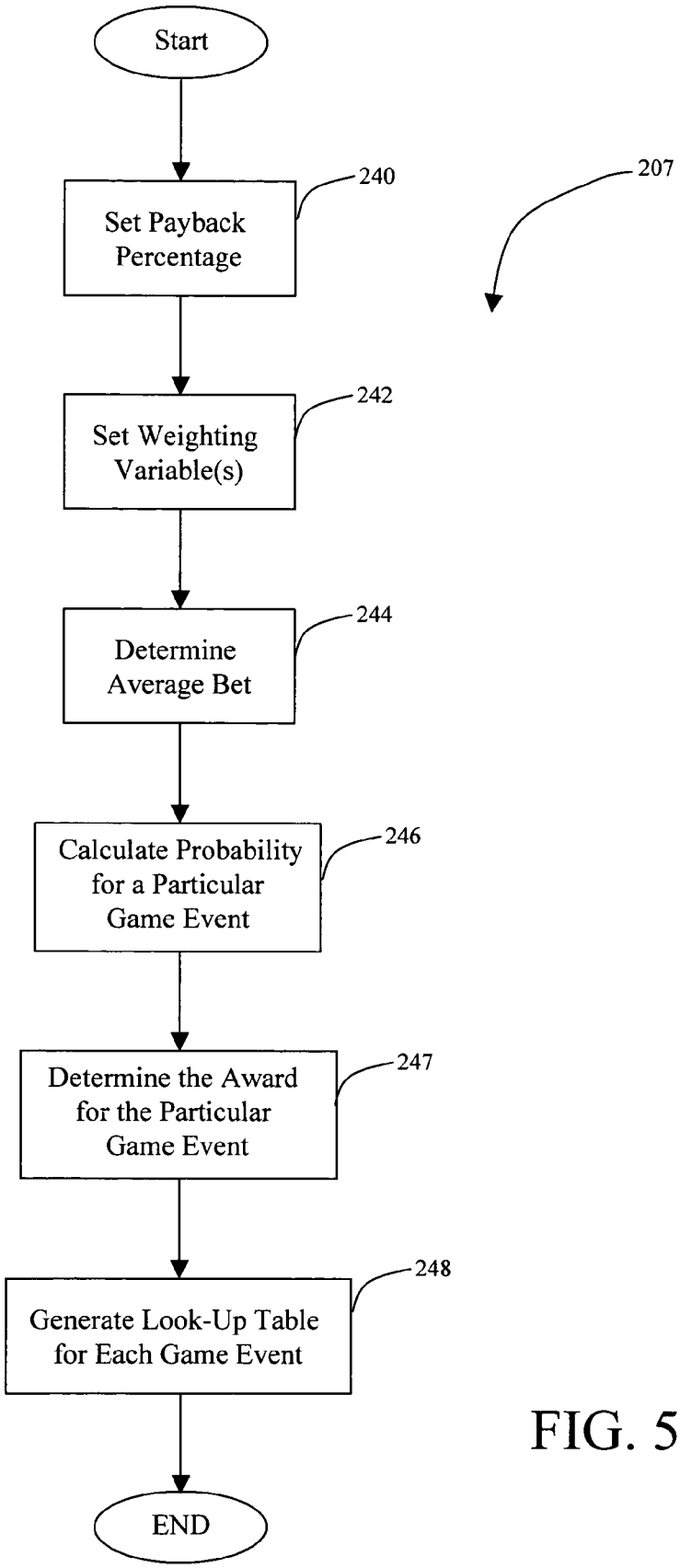
FIG. 5 is a flowchart for the illustrative paytable process.

Referring to FIG. 5 there is a flow chart showing an illustrative embodiment for generating the dynamic paytable. The dynamic paytable is referred to in process blocks 207, 215 and 221 of FIG. 3.

The paytable is a dynamic paytable that is generally modified after each game event within the game session. Typically, a game event is the drawing of one or more bingo numbers. The dynamic paytable identifies a plurality of bingo patterns. The prize credits awarded for each bingo pattern are modified after each game event that does not result in awarding the player a prize. The prize credits awarded to the player for a "winning" bingo pattern is referred to as a triggering event. Thus, each triggering event is associated with a winning bingo pattern. The dynamic paytable also reflects one or more threshold event which determines the prize credits awarded for each subsequent winning bingo pattern. The threshold event is engaged after one or more triggering events and determines prize credits for each subsequent bingo pattern.

By way of example and not of limitation, a dynamic paytable may be modified as a function of dynamic variables that include: the number of matching bingo numbers; the remaining bingo numbers after each drawing; the total quantity of bingo numbers; and the contribution or allocation of each award level to the overall payback. For the chargeable action embodiment, the dynamic paytable may also be dependent on the amount of credits associated with each chargeable action. For the average bet embodiment, the dynamic paytable may depend on the number of total credits wagered at the beginning of the game session.

Fundamentally, the dynamic paytable is calculated based on the probabilities associated with the future game event, i.e. the picking of the next game selected symbol. The calculation of the future probabilities for the next game event are based on the prior game events that took place during the game session. Once the probabilities for the next game event are known, then the pay amounts for the paytable are calculated. However, the dynamic paytable described herein includes additional components as described below.

Referring to block 240, the "payback" percentage is set into the game. Preferably, the pay amounts distributed to the player provides a "payback" that remains constant. By way of example and not of limitation, the paytable may be programmed to provide a constant 90% payback to the player. Generally, the payback percentage for the interactive game is determined by the operator, e.g. a casino. For purposes of this disclosure, the payback percentage is referred to as ROI. The method then proceeds to block 242.

At block 242 the weighting variables are set. In one illustrative embodiment an arbitrary weighting function is chosen. The arbitrary weighting function may be used to more heavily weight the probabilities in the player's favor for game events that occur at the end of the game session. By way of example, the weighting function may be a formula as shown below:

$$WGT(I)=(I+36)/75$$

The variable "I" in the weighting function refers to the quantity of bingo numbers that have been drawn. Thus, if only one number is picked by the game, the arbitrary weighting function is approximately 0.5, and if sixty-one bingo numbers are picked then the arbitrary weighting function is approximately 1.29.

Another weighting function that may also be used to develop the dynamic paytable includes an allocation weighting function. The allocation weighting function determines the percentage of the total prize awarded for each "winning" bingo pattern. By way of example and not of limitation, the allocation weighting function may provide a 0.3 award when the bingo variation of a "row" of bingo numbers occurs, and a 0.3 award when the bingo variation of "four corners" occurs, and a 0.4 award when the bingo variation of "blackout" occurs. The total for the allocation awards is 1.0 and is the sum of the awards: 0.3+0.3+0.4. The allocation weighting function is used because of the dependent nature of the events in the interactive game. For purposes of this disclosure, the allocation weighting function is referred to as AL(IHIT). The method then proceeds to block 244.

At block 244, the average bet is determined based on the structure of the game. The average bet may be determined empirically or theoretically. The average bet is a function of the quantity of player selected numbers. For purposes of this disclosure the average bet is referred to as ABET. The method then proceeds to block 246.

At block 246, the probability for the next game event is calculated. It shall be appreciated by those of ordinary skill in the art having the benefit of this disclosure that the probability of a next game event is the product of probabilities of prior game events multiplied by the probability associated with the next game event. For purposes of this disclosure, the probability for the next game event is referred to as PR(I). The method then proceeds to block 247.

At block 247, the award for the each game event is determined. The prize awarded is given by the equation provided below:

$$\mathrm{PAY}(I)=\mathrm{ROI}*A\mathrm{BET}*WGT(I)*AL(I\mathrm{HIT})/\mathrm{PR}(I)$$

For purposes of the equation, the prize awarded is referred to as PAY (I). The method then proceeds to block 248.

At block 248, a plurality of look-up tables are generated for each game event. As shown above, an award is calculated for each picked game number. In a traditional bingo game, there are 75 numbers that may be picked during a game event.

Illustrative Operation of Interactive Bingo

Figure 6:
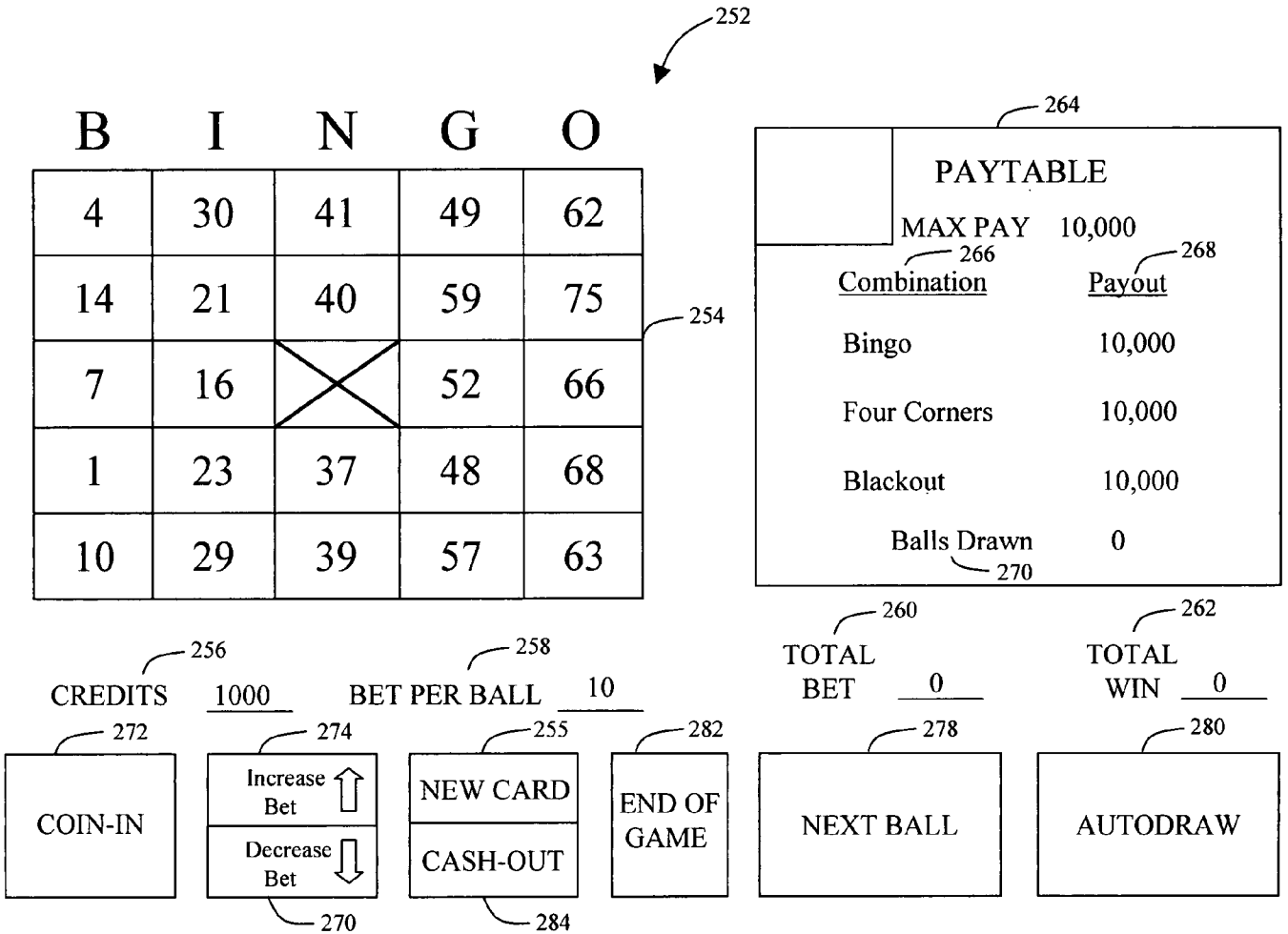
FIG. 6 is an illustrative example of a player interface after the game conditions are input into the interactive bingo game.

Referring to FIG. 6, there is shown the illustrative player interface for the chargeable action bingo embodiment described above. Those skilled in the art shall appreciate that the chargeable action embodiment may be modified to perform the average bet embodiment as described above. The illustrative chargeable action bingo embodiment includes a player interface 252 that operates on the illustrative touch screen display 112 of FIG. 1. The touch screen 112 displays the interactive bingo game that is configurable by the player. Preferably, the interactive bingo game is displayed one game session at a time. Alternatively, the bingo game may display a plurality of game sessions.

Each game session is made up of at least two game events. During each game event a bingo number is picked or drawn from a set of bingo numbers. For the chargeable action embodiment, the player is charged at least one credit for each game event. The process of charging the player for each game event is referred to as a "chargeable action." In the average bet embodiment, the player is charged only once during the beginning of the game session.

In the illustrative embodiment, a game session is initiated when the player provides money or transferable credits as described above. Once player credits are received by the interactive bingo gaming system, the game session is initiated and a card component 254 is displayed. The player has the option of selecting another bingo card by pressing new card button 255.

After the card component 254 is displayed and the player credits are displayed by the credit meter 256, the player identifies the credits that will be applied towards each "chargeable action" with a "Bet Per Ball" meter 258. In the present invention, the player is charged a predefined number of credits for each bingo number that is drawn or picked during the game event. The "Bet Per Ball" meter 256 identifies the condition that determines the predefined number of credits that will be charged to pick each game number.

During the game session, a total bet meter 260 provides a summary of the total number of credits wagered by the player during the game session. Thus, the credits that are applied for each chargeable action during the game session are monitored with the total bet meter 260. A total win meter 262 is also provided. The total win meter 262 informs the player of the number of credits that player has been awarded during the game session. Thus, illustrative player interface 252 includes a plurality of meters that monitor each interactive bingo game session.

A paytable 264 to the right of card component 254 indicates the possible prizes that may be awarded to the player. The paytable may be a dynamic paytable or a static paytable. The dynamic paytable is a paytable that is modified during the game session as described above. The static paytable is a paytable that does not change during a game session.

In the illustrative embodiment of FIG. 6, the paytable 264 is configured to provide a payout for three different Bingo variations or combinations. The paytable 264 is comprised of a combinations column 266 and a payout column 268. The combinations column 266 describes the type of combination needed to receive the payout shown in payout column 268. Furthermore, a balls drawn meter 270 captures an output of the quantity of bingo numbers that were picked during the game session.

Before initiating game play, the player must have available credits in the credit meter 256. Credits are transferred to the credit meter using the coin-in button 272. Additionally, before initiating game play the player must transfer credits from the credit meter 256 to the bet per ball meter 258.

The player transfers credits from the credit meter 256 using the increase bet button 274 or the decrease bet button 276. The increase bet button 276 increases the number of credits that are shown by the bet per ball meter 258 and the decrease bet button 276 decreases the number of credits that are shown by the bet per ball meter 258.

In the chargeable action embodiment, the chargeable action occurs when either the next ball button 278 or the autodraw button 280 is activated. The next ball button 278 engages the picking of a single bingo game number from the range of game numbers 1 through 75. The player may also initiate the game session using the autodraw button 280. The autodraw button 280 is configured to automatically pick at least one bingo game number at a time until one of the desired bingo patterns. Additionally, the game session may be paused manually by the player after any game event.

Before activating the next ball button 278 or the autodraw button 280, the player has an opportunity to view the paytable 264. Preferably, the paytable 264 is dynamic and is revised during the game session. The displayed paytable provides the player with an opportunity to determine if the player payout is satisfactory to the player. The ability to view the dynamic paytable permits the player to use the player's skill to determine whether to continue the game session or terminate the game session. Additionally, the player can view the number of balls drawn meter 270, the total bet meter 260 and the total win meter 262 to determine whether to continue the game session.

By providing the player with a decision making opportunity during the game session, the player can use the player's knowledge based skill to preserve winnings and minimize losses. By preserving winnings and minimizing losses, the player can enjoy playing the interactive bingo game for a much longer period of time. If the player did not possess knowledge based skill to preserve winnings and minimize losses, the player would quickly spend his available credits.

Additionally, the player may reset the game using the end of game button 282. The end of game button 282 begins a new game session. Finally, should the player decide that they want to conclude the game, the cash-out button 284 button is activated. The cash-out button 284 transfers credits or money to the player using well-known techniques that include depositing coins in a coin hopper or transferring credits or money to a coupon that is redeemable at other machines or kiosks.

During the game session, the player may also be awarded an intermediary prize after a game event. The intermediary award is then be transferred to the credit meter 256 so that the player may apply the newly awarded credits towards continuing the game session. In the autodraw embodiment, the game session is paused after the intermediary prize is awarded and the player is provided with an opportunity to determine whether to continue the game session. The awarding of an intermediary prize adds a heightened level of player interactivity because the player may decide to end the game session after the intermediary prize is awarded.

Figure 7:
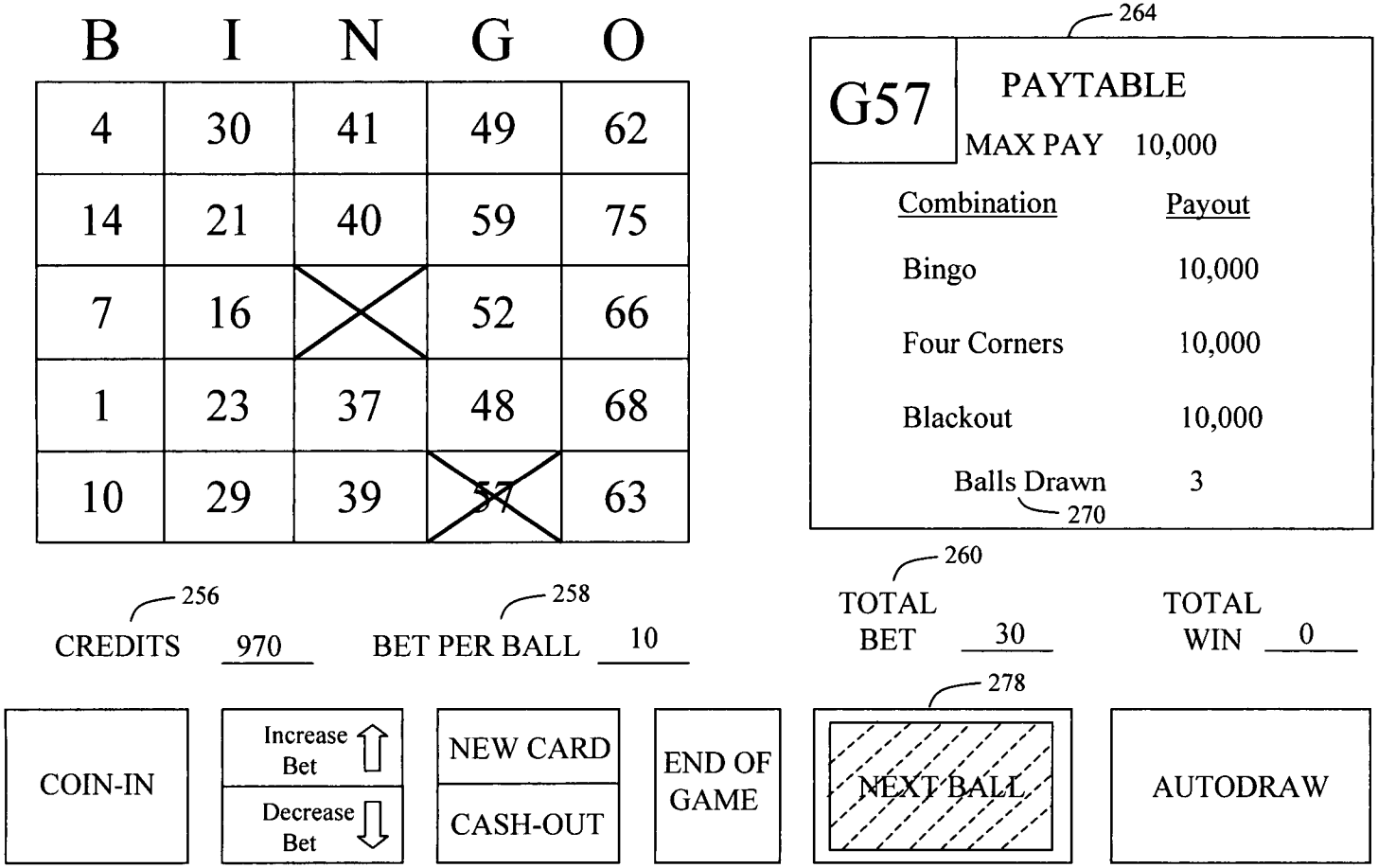
FIG. 7 is an illustrative example of the player interface after the Next Ball button has been activated.

FIG. 7 through FIG. 10 provide screen shots of an illustrative bingo game session. In FIG. 7, the player has selected the bingo game card of FIG. 6 for the game session. Additionally, the player has elected to wager 10 credits for each ball that is drawn, i.e. each chargeable action. The 10 credit wager for each chargeable action is indicated by the bet per ball meter 258. Additionally, FIG. 7 shows that three game events have transpired. The three game events have resulted in a decrementing of the credit counter 256 by 30 credits, and an incrementing of the balls drawn meter 279 and the total bet meter 30. Each of the three game events was engaged by pushing the next ball button 278. After the three game events only one picked number, G57, matches the numbers on the bingo game card.

Figure 8:
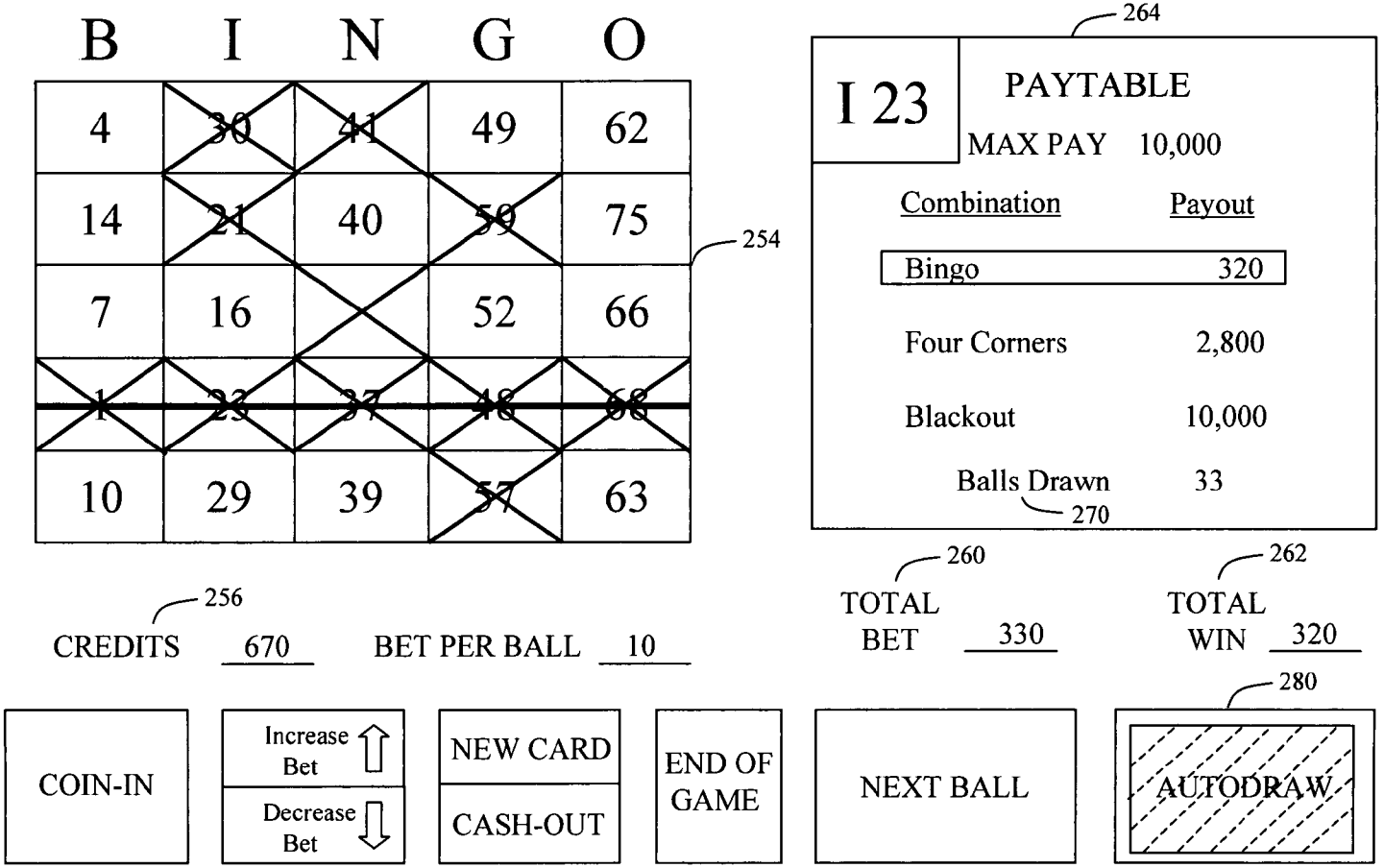
FIG. 8 is an illustrative example of the player interface after the Autodraw button has been activated for the first time.

Referring to FIG. 8 there is shown an illustrative screen shot of the player interface after the autodraw button 280 is engaged and the game session has been paused. The game session in FIG. 8 has been paused because a "bingo" pattern has been generated. The first "bingo" pattern is also referred to as the first triggering event for the dynamic paytable. The paytable 264 indicates that the prize for the bingo combination was 320 credits which have been registered in the total win meter 262. The balls drawn meter 270 indicates that 33 bingo numbers have been drawn to generate the bingo combination. The bingo combination is a horizontal row of numbers as shown by card component 254. The remaining portion of the dynamic paytable displays prize credits awarded for each subsequent bingo pattern. The prize credits for each subsequent bingo pattern is also dynamic and is referred to as a threshold event. The threshold event is engaged after one or more triggering events and is configured to determine the prize credits for each subsequent bingo pattern. The prize credits are determined based on a plurality of variables as described in FIG. 5 above.

During each game event for the illustrative game session, the chargeable action of picking one bingo game number requires withdrawing 10 player credits from the credit meter 256. Since there were 33 balls drawn and the bet per ball was 10, the player credit meter 256 is decremented 330 credits to display 670 available credits and the corresponding total bet meter 260 is incremented 330 credits. At this point, the player has the option of terminating the game session or continuing the game session. In the illustrative game session, the player decides to push the autodraw button 280 again. The player decision to continue the game session may be based on the player's evaluation of the existing paytable, the number of bingo balls drawn, a probabilistic analysis of the bingo numbers shown in the card component, a historical understanding of an award system for the game, or any other such parameter that is based on the player's knowledge.

Figure 9:
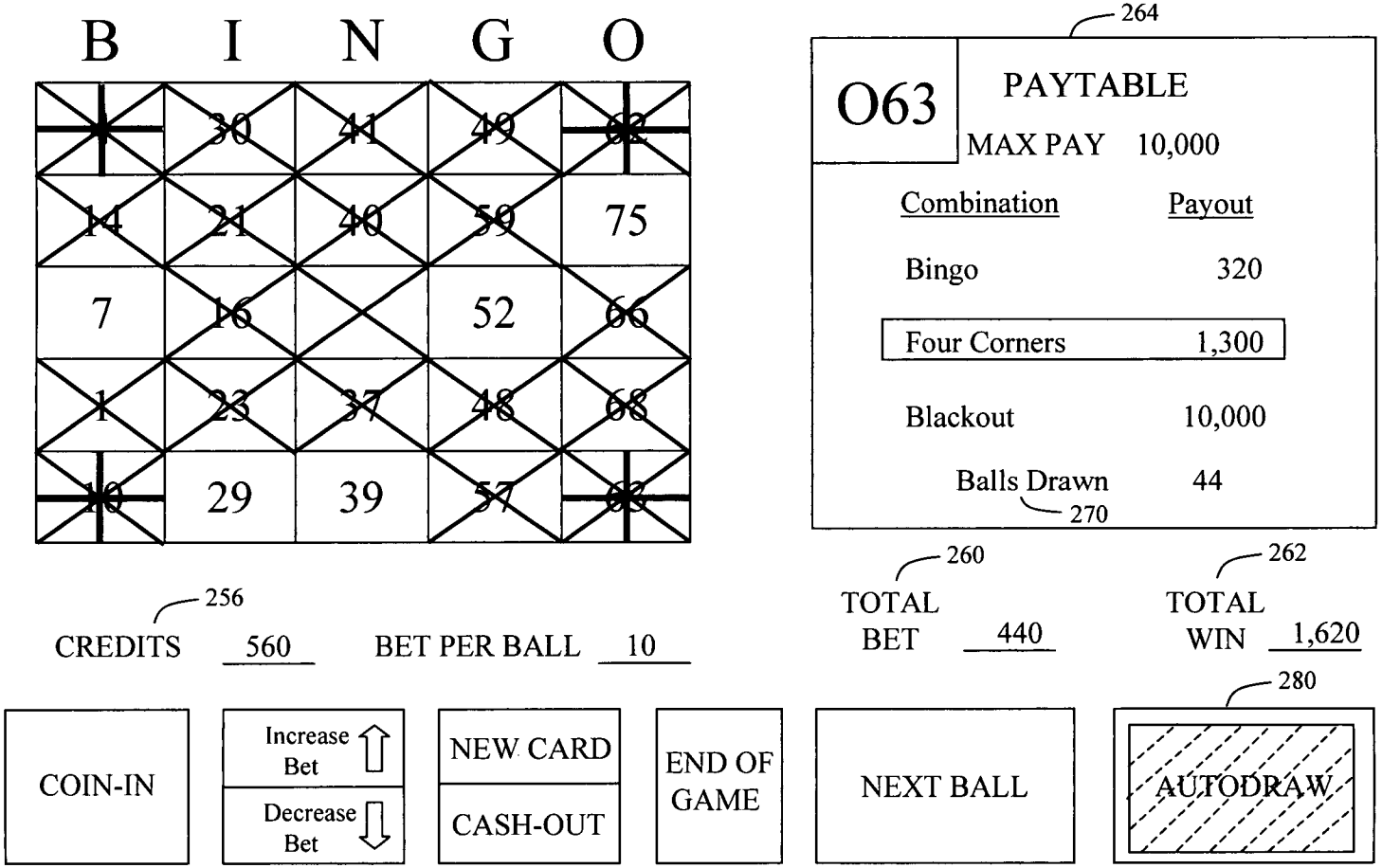
FIG. 9 is an illustrative example of the player interface after the Autodraw button has been activated for the second time.

Referring to FIG. 9 there is shown an illustrative screen shot of the player interface after the autodraw button 280 is engaged a second time and the game session has been paused because the "Four Corners" combination has been realized. The paytable 264 indicates that the prize for the Four Corners combination was 1,300 credits. The 1300 credits and the 320 previously won credits are displayed by the total win meter 262. The balls drawn meter 270 indicates that 44 bingo numbers have been drawn to generate the Four Corners combination which is defined by having bingo numbers that match the four corners of the bingo card. The chargeable action of picking 44 bingo numbers results in the player credit meter 256 being decremented 440 credits to display 560 available credits and the corresponding total bet meter 260 is incremented to display 440 credits.

Again, the player has the option of terminating the game session or continuing the game session. In this illustrative game session, the player decides to push the autodraw button 280 for a third and final time. As described above, the player's decision to continue the game session may be based on the player's evaluation of the existing paytable, the number of bingo balls drawn, a probabilistic analysis of the bingo numbers shown in the card component, a historical understanding of an award system for the game or any other such parameter that is based on the player's knowledge.

Figure 10:
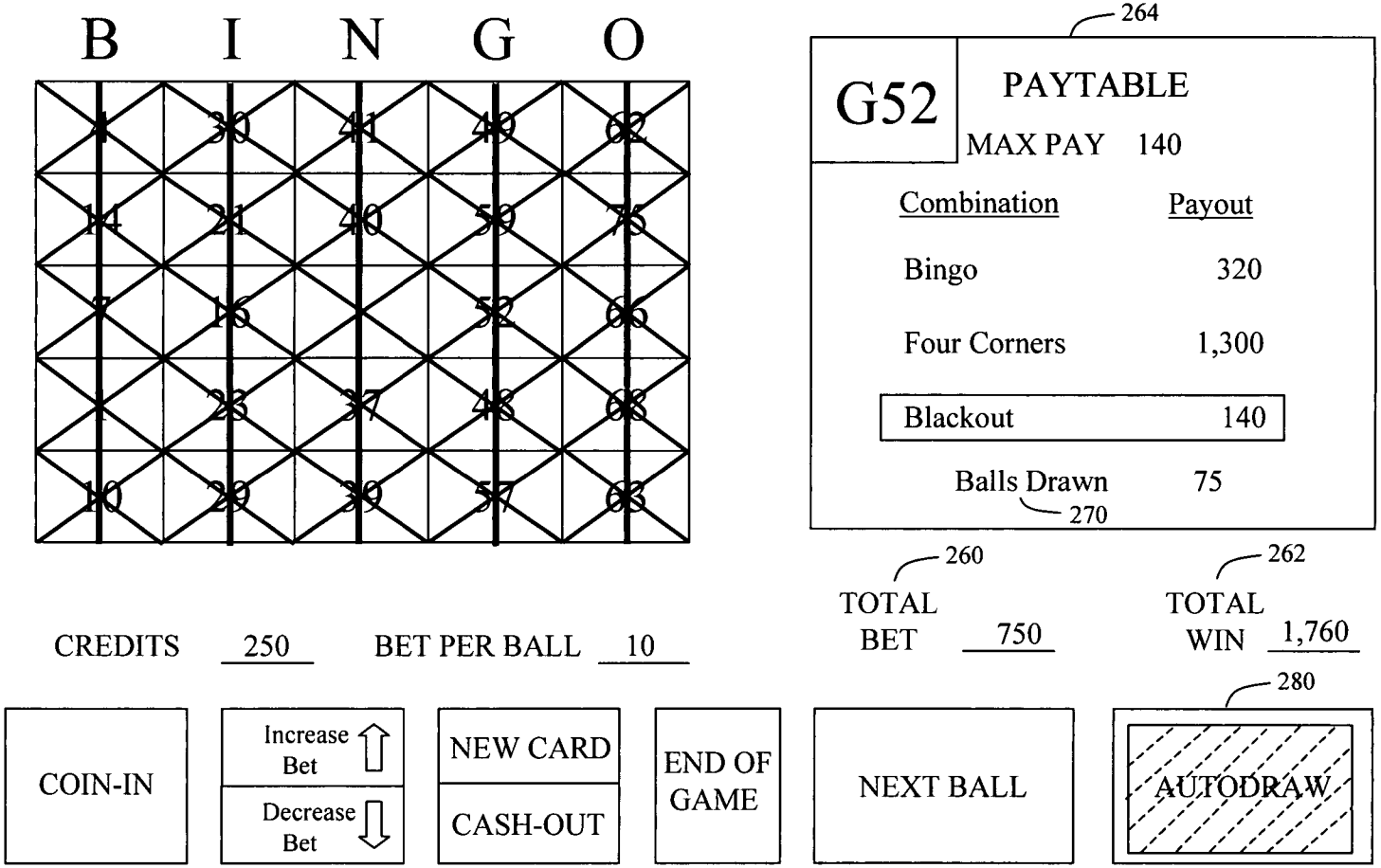
FIG. 10 is an illustrative example of the player interface after the Autodraw button has been activated for the third time.

Referring to FIG. 10 there is shown an illustrative screen shot of the player interface after the autodraw button 280 has been engaged a third time and the "Blackout" combination has been realized. After the Blackout combination is achieved, the game session is ended. The paytable 264 indicates that the prize for the Blackout combination was 140 credits. The win meter 262 displays the total 1,760 credits that were awarded to the player during the game session. The balls drawn meter 270 indicates that all 75 bingo numbers were drawn to generate the Blackout combination and a total of 750 credits were wagered.

Illustrative Skill Strategy for Interactive Bingo

For purposes of this patent, "player skill" includes three components: minimal skill, dexterity skill, and knowledge skill. Generally, all games include these components, however, the degree of skill varies for each game. As described above, minimal skill refers to the player having a minimal understanding of the rules of the game and minimal dexterity needed to apply the rules of the game. To play a game according to the game rules, the player must possess minimal skill. However, minimal skill is not required. Dexterity skill is based on the player's reflexes or coordination. Most games require a degree of dexterity to establish game play. Certain games such as arcade video games or pinball machines are primarily dexterity based skill games. Knowledge skill is based on the player's experience and analytical abilities.

Figure 11:
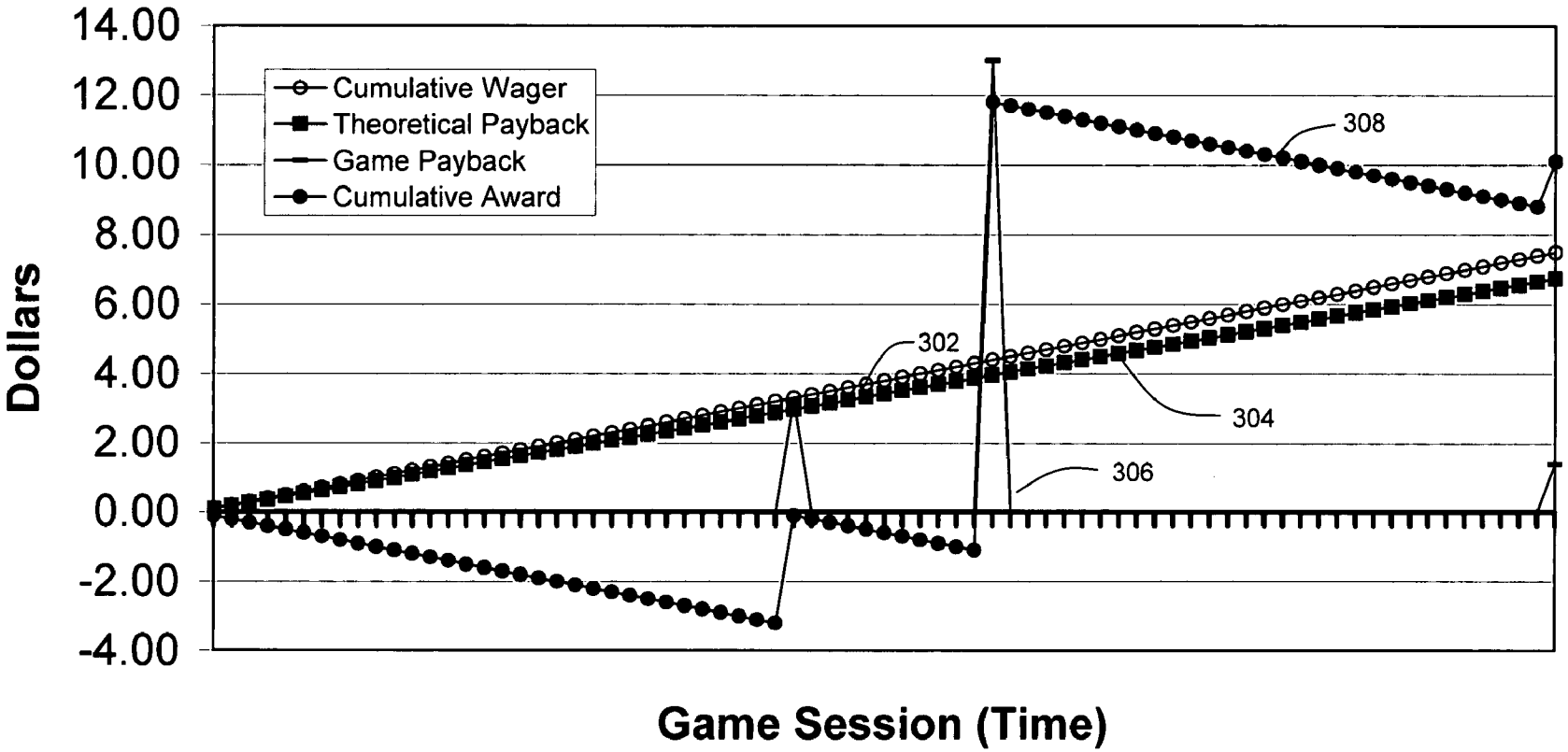
FIG. 11 is an illustrative chart that may be used to develop a player strategy to preserve game winnings.
Figure 12:
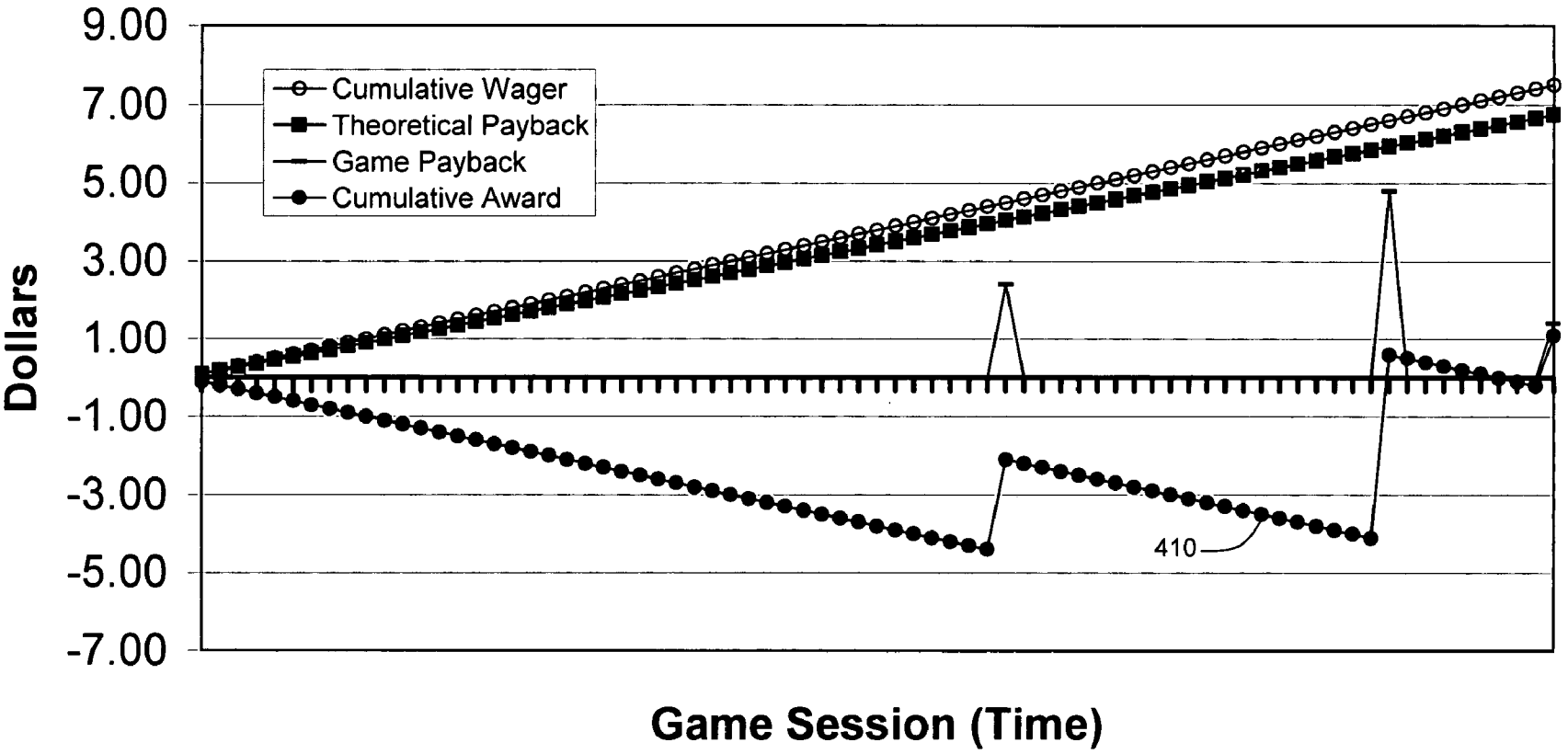
FIG. 12 is an illustrative chart that may be used to develop a player strategy to reduce game losses.

As described above, the interactive bingo game displays the dynamic paytable to the player after each game event. Additionally, the bingo game provides the player with an opportunity to terminate or continue the game session after each game event. In operation, the dynamic paytable may be used to help the player select a strategy that preserves the player's winnings or a strategy that will minimize the player's losses. The player strategy may include one of a plurality of strategies or combinations of strategies such as the player's evaluation of: the existing paytable; the number of bingo balls drawn; a probabilistic analysis of the bingo numbers shown in the card component; a historical understanding of an award system for the game; or any other such parameter that is based on the player's knowledge based skill. As shown in FIG. 11 and FIG. 12, a skill based strategy can be developed from two illustrative game sessions.

For illustrative purposes, the chargeable action embodiment is described in further detail in FIG. 11 in which there is shown an illustrative chart that may be used to develop a player strategy to reduce game losses. It shall be appreciated by those of ordinary skill in the art having the benefit of this disclosure that similar skill strategies may be applied for the average bet embodiment. A first line 302 represents a cumulative wager amount. The cumulative wager amount line 302 tracks the total amount wagered by the player after each game event. For FIG. 11 and FIG. 12, the illustrative the wager amount is $0.10 per game event, i.e. the chargeable action is $0.10.

The theoretical payback line 304 is a cumulative payback that is made to the player, and is based on the payback percentage for playing the interactive bingo game. The payback percentage is based on the assumption of the player's use of minimal skill for the entire game session in which a theoretically large population of game sessions is normalized over a single game session. For illustrative purposes minimal skill occurs when the player hits the next ball button or autodraw button until no more game events are capable of being conducted. Minimal skill occurs because the player is unable to terminate the game session early to preserve winnings or minimize losses. Knowledge based skill is used to determine when to terminate the interactive bingo to either preserve winnings or reduce player losses during a game session.

By way of example and not of limitation, if the payback percentage is 90% for each game event, then the minimal payback for each $0.10 game event is $0.09. The minimal payback line 304 assumes that the payback percentage is fixed for each game event. It shall be appreciated by those skilled in the art, that the minimal payback percentage is developed over the course of playing many game sessions rather than just a single game event.

The game payback line 306 identifies the prizes that were awarded to the player during the illustrative bingo game session discussed above in FIG. 6 through is FIG. 10. As shown by game payback line 306, the player was awarded a prize after having drawn 33, 44 and 75 bingo balls.

The cumulative award line 308 is the game payback values represented by game payback line 306 subtracted from the cumulative wager values represented by the cumulative wager line 302. Thus, the cumulative award line 308 represents the total prizes awarded to the player minus the amount charged to the player for each game event. The cumulative award line 308 includes a plurality of spikes generated when the player is awarded the prizes at game event 33, 44, and 75. The cumulative award line 308 shows that the optimum time for the player to have terminated the game was after 44 bingo balls were drawn and the player was awarded a prize of 1,300 for hitting the Four Corners combination.

Based on the chart in FIG. 11, the player may develop a strategy in which the player terminates the game session when the cumulative award 308 exceeds the cumulative wager 302. If the player had adopted this strategy the player would have surpassed the total amount wagered by 1180 credits. By playing the game session with minimal skill the player would have surpassed the total amount wagered by only 1010 credits. In this illustrative example, the difference between adopting an effective knowledge based skill strategy and a minimal skill strategy is 170 credits. This illustrative strategy permits the player to exceed the 90% payback associated with minimal skill.

Referring to FIG. 12 there is shown an illustrative chart that may be used to develop a player strategy to minimize game losses. The cumulative award line 410 reflects that the player won 240 credits after 45 bingo numbers were drawn, 480 credits after 66 bingo numbers were drawn and 140 credits after 75 bingo numbers were drawn. During the game session, the player was charged 750 credits for drawing 75 bingo numbers. By way of example and not of limitation, the player may adopt a simple strategy of NOT terminating the game session early so that the player can recover his "investment".

By adopting this simple strategy the player may minimize game losses. As shown in the chart, after 44 bingo numbers had been picked, the total bet meter reflected that 440 credits had been wagered and 0 credits had been won. The player strategy of terminating the game session after 44 bingo numbers had been drawn would have been a poor decision. By adopting the strategy of continuing the game session, the player was able to recover the 440 credits wagered. At the end of the game session, the total bet meter indicated that 750 credits had been wagered and the total win meter indicated that 860 credits had been awarded to the player.

If these simple knowledge based skill based strategies results in a small increase of 1% from the minimum payback percentage of 90%, then the increased payback percentage results in the player achieving an 11% improvement in the amount of playing time. If the skill based strategy results in an increase of 2% for the minimum payback percentage of 90%, then the player achieves a 25% improvement in the amount of playing time.

It shall be appreciated by those skilled in the art having the benefit of this disclosure that the skill based strategy provided above is an illustrative strategy. A plurality of different strategies may be adopted by the player during the game session. An effective knowledge based strategy will provide an improved payback percentage that exceeds the minimum payback percentages associated with a minimal skill based strategy.

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the illustrative examples given.

What is claimed is:

1. A method of playing an interactive bingo game, comprising:

initiating a game session on a gaming device that comprises, a plurality of game events corresponding to the game session, a chargeable credit game condition, in which a first player selection is received for charging at least one credit for each game event;

providing on a player interface, a player a bingo card having a plurality of integers configured in a grid pattern;

performing the game events on the gaming device so that each game event comprises having the interactive game draw at least one bingo number from a set of bingo numbers;

charging a player a quantity of credits obtained from an input component of the gaming device for each of the game events according to the chargeable credit game condition;

awarding by the gaming device to said player one or more prizes according to a dynamic paytable that depends on a plurality of dynamic variables that are modified after each game event that charges according to the chargeable credit game condition, the dynamic paytable comprising, a plurality of payouts wherein each payout is associated with a corresponding game event, a plurality of triggering events wherein each triggering event is associated with one of a plurality of bingo patterns, a threshold event that is engaged after one or more triggering events, said threshold event configured to determine a plurality of prize credits awarded for each subsequent bingo pattern;

repeatedly displaying each payout for the corresponding game event;

repeatedly modifying the payouts during the game session for each game event so that each payout is modified according to a graduated weighting function that weighs probabilities more favorably as more game events are played during the game session; and enabling the dynamic paytable to be modified after each game event according to an equation:

$$\mathrm{PAY}(I)=\mathrm{ROI}*A\mathrm{BET}*WGT(I)*AL(I\mathrm{HIT})/\mathrm{PR}(I)$$

where,

PAY(I) is a payout for a bingo pattern;

ROI is an overall payback percentage;

ABET is an average bet;

WGT(I) is a graduated weighting function that weighs probabilities more favorably for game events that occur at the end of the said game session;

AL(IHIT) is a pay allocation weighting function that determines the percentage of the total prize awarded for the bingo pattern; and PR(I) includes a probability for the next game event, wherein the next game event is the bingo number picked from the set of bingo numbers.

2. The method of claim 1 further comprising permitting said player to terminate said game session after each game event.

3. The method of claim 2 further comprising permitting said player to use player skill in deciding whether to terminate said game session.

4. The method of claim 3 further comprising providing said player a plurality of bingo cards.

5. The method of claim 4 wherein said plurality of bingo patterns includes at least one row of drawn bingo numbers on said bingo card, said row being horizontal, vertical or diagonal.

6. The method of claim 4 wherein said plurality of bingo patterns includes a four-corner bingo pattern.

7. The method of claim 4 wherein said plurality of bingo patterns includes a blackout bingo pattern.

8. The method of claim 4 wherein said plurality of dynamic variables comprises a quantity of player credits wagered for each chargeable action.

9. The method of claim 4 wherein said determining of said plurality of prize credits to award for each of said plurality of bingo patterns is based on an allocation variable which is associated with said dynamic variable.

10. The method of claim 1 further comprising networking a plurality of interactive games.

11. An interactive bingo gaming system, comprising:

a player interface configured to display at least one bingo card and configured to display the interactive bingo gaming system drawing at least one bingo number from a set of bingo numbers;

a credit meter configured to record charging a player one or more credits for initiating a game session, said game session comprising, receiving a chargeable credit condition when initiating the game session, in which a first player selection is received for charging at least one credit for each game event, performing a plurality of game events wherein each game event comprises having said interactive game draw said at least one bingo number from said set of bingo numbers, charging a player a quantity of credits for each of the game events according to the chargeable credit game condition;

a dynamic paytable that depends on a plurality of variables that are modified after each game event that charges according to the chargeable credit game condition, said dynamic paytable comprising, a plurality of payouts wherein each payout is associated with a corresponding game event, a plurality of triggering events wherein each triggering event is associated with one of a plurality of bingo patterns, a threshold event that is engaged after one or more triggering events, said threshold event configured to determine a plurality of prize credits awarded for each subsequent bingo pattern, repeatedly displaying each payout for the corresponding game event, and repeatedly modifying the payouts during the game session for each game event so that each payout is modified according to a graduated weighting function that weighs probabilities more favorably as more game events are played during the game session, wherein the payouts are modified after each game event according to an equation, $$PAY(I)=ROI*ABET*WGT(I)*AL(IHIT)/PR(I)$$

where

PAY(I) is a payout for a bingo pattern;

ROI is an overall payback percentage;

ABET is an average bet;

WGT(I) is a graduated weighting function that weighs probabilities more favorably for game events that occur at the end of the said game session;

AL(IHIT) is a pay allocation weighting function that determines the percentage of the total prize awarded for the bingo pattern;

PR(I) includes a probability for the next game event, wherein the next game event is the bingo number picked from the set of bingo numbers;

a prize meter which is incremented each time said threshold event occurs; and a termination button that permits said player to terminate said game session after each game event.

12. The system of claim 11 wherein said plurality of bingo patterns includes at least one row of drawn bingo numbers on said bingo card, said row being horizontal, vertical or diagonal.

13. The system of claim 11 wherein said plurality of bingo patterns includes a four-corner bingo pattern.

14. The system of claim 11 wherein said plurality of bingo patterns includes a blackout bingo pattern.

15. The system of claim 11 wherein said plurality of dynamic variables comprises said player credits wagered for each chargeable action.

16. The system of claim 11 wherein said plurality of dynamic variables comprises an allocation variable that determines said plurality of prize credits to award for each of said bingo patterns.

17. The system of claim 11 further comprising a network interface card communicatively coupled to said processor, said network interface card permits said interactive gaming system to communicate with another networked device.

* * * * *